United States Patent [19]

Schregenberger

[11] 4,053,993

[45] Oct. 18, 1977

[54] OVEN FOR A PROCESSION OF CONTAINERS

[75] Inventor: Alex J. Schregenberger, Neshanic Station, N.J.

[73] Assignee: Midland-Ross Corporation, Cleveland, Ohio

[21] Appl. No.: 689,410

[22] Filed: May 24, 1976

[51] Int. Cl.[2] ..... F26B 25/00

[52] U.S. Cl. ..... 34/105; 34/216; 34/225; 34/233

[58] Field of Search ..... 34/104, 105, 236, 216, 34/217, 224, 225, 233, 21; 432/224, 225

[56] References Cited

U.S. PATENT DOCUMENTS

| | | | |
|---|---|---|---|
| 2,835,003 | 5/1958 | Abrams | 34/236 |
| 3,574,952 | 4/1971 | Lee, Jr. | 34/105 |
| 3,729,832 | 5/1973 | Lund | 34/105 |

*Primary Examiner*—Kenneth W. Sprague
*Assistant Examiner*—James C. Yeung
*Attorney, Agent, or Firm*—Woodrow W. Portz

[57] ABSTRACT

Disclosed is apparatus for simultaneously subjecting the inside and outside surfaces of a procession of containers to a gaseous treatment, such as the hardening by heating of a previously applied liquid coating. The containers each provide a closed end and another open end by which it rests on a conveyor which carries a procession of the cans through a treatment region. Structure is provided for the creation of a difference in air pressure as applied to different portions of the open ends of the containers to induce air currents interiorly of thereof.

13 Claims, 12 Drawing Figures

FIG.4
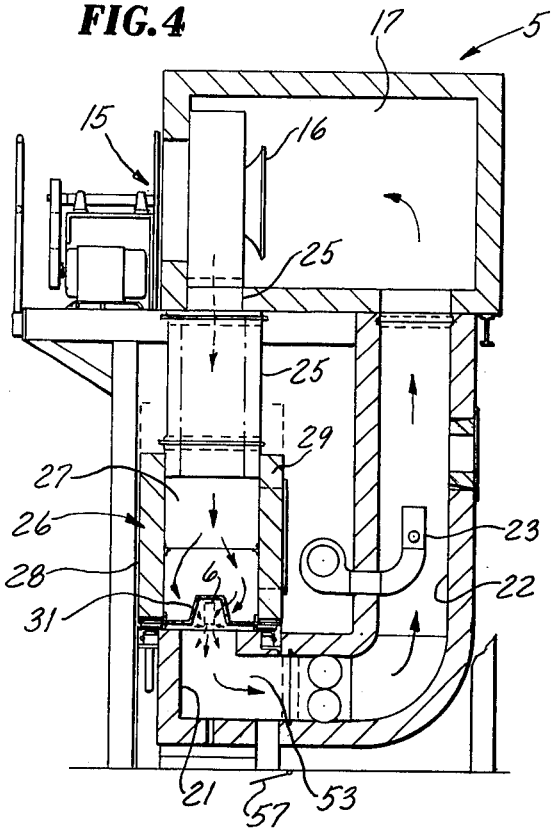
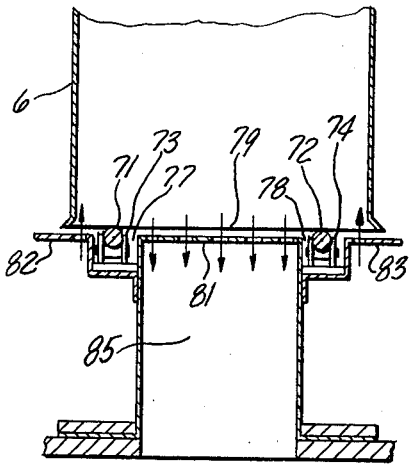
FIG.5
FIG.7
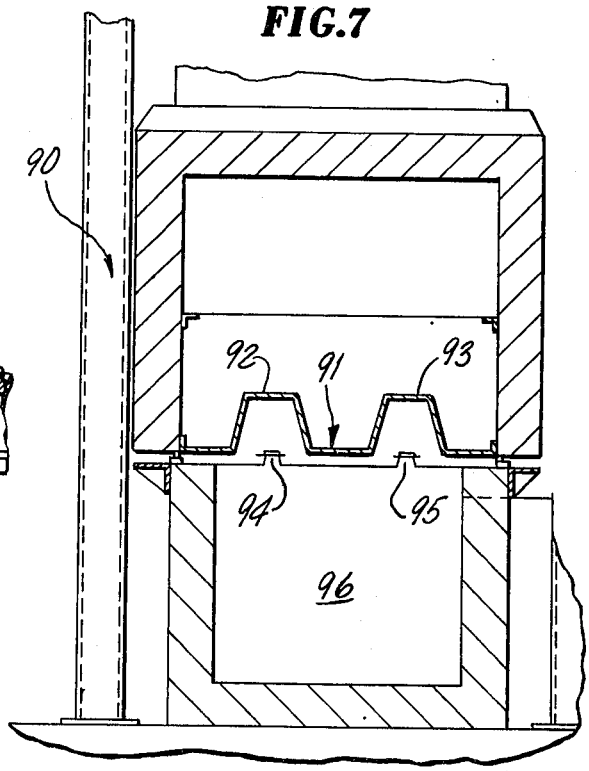
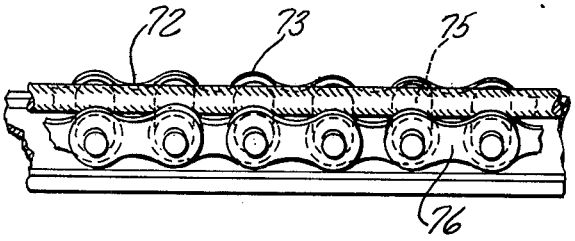
FIG.6

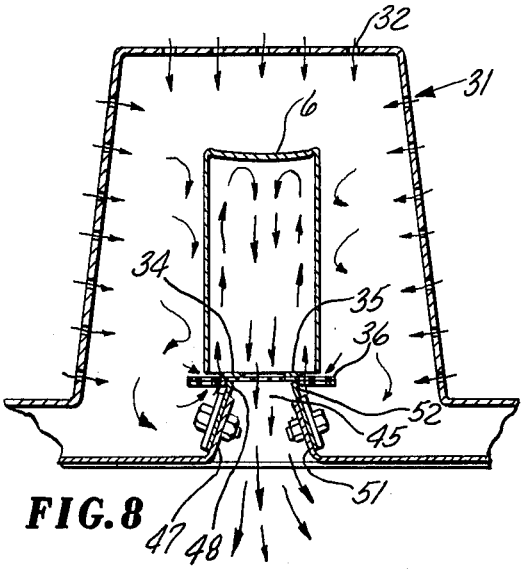
FIG.8
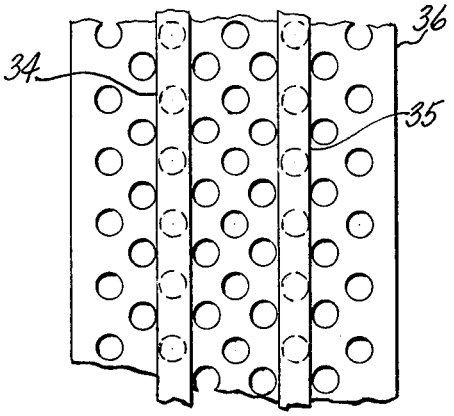
FIG.9
FIG.10
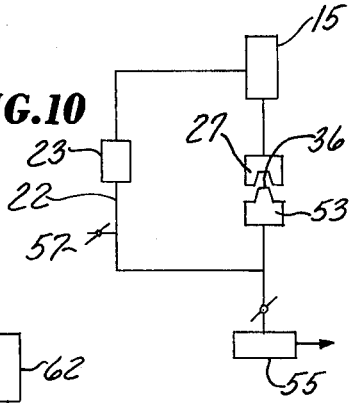
FIG.11
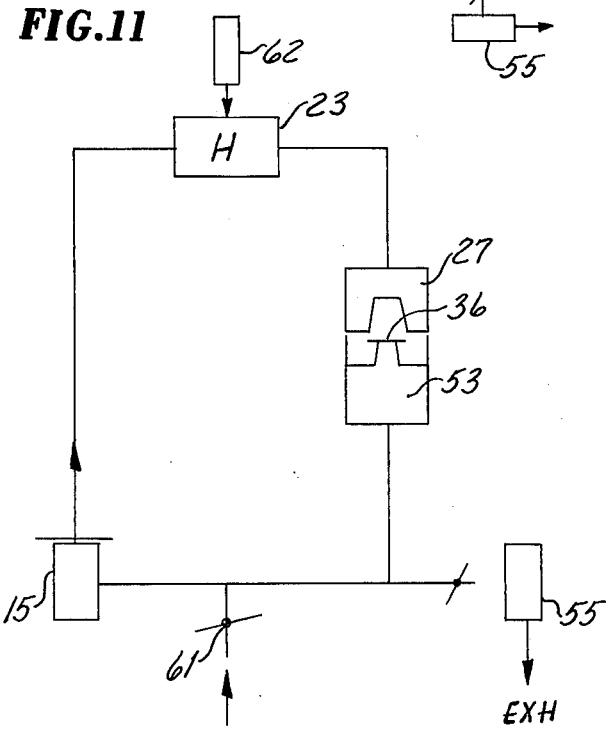
FIG.12
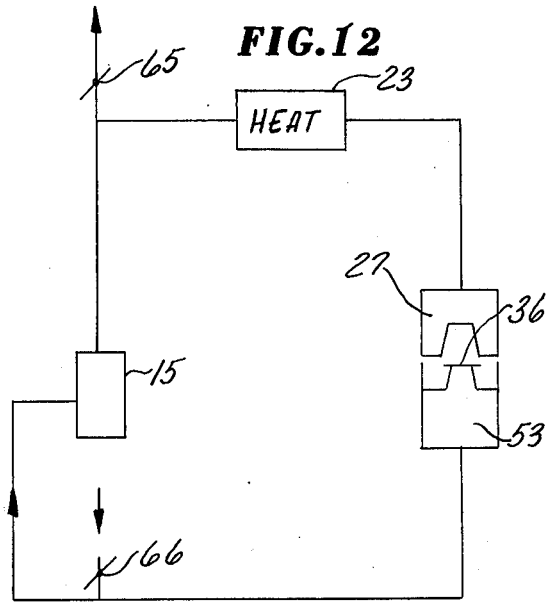

OVEN FOR A PROCESSION OF CONTAINERS

BACKGROUND OF THE INVENTION

Coating and the printing of labels on small metal cans is a huge volume operation throughout the beverage industries. Under present technology and in a typical installation, the cans are coated or printed with a liquid composition and passed through what is known as a "pin oven" wherein the cans are subjected to air at temperatures, such as 600° F., while being carried through an upward and downward zig-zag path on a chain equipped with horizontally extending can-supporting pins spaced along a chain much as described in U.S. Pat. No. 3,381,391. Typically, the cans are carried by a chain and pin assembly into and through an oven from a printing or coating machine by chain-propelling mechanism which is mechanically connected with the printing machinery to be synchronized therewith to start up, operate and stop together. Under the rapid air movement conditions within the oven, the air is directed primarily against the closed ends of the cans to assure that they remain on the pins. Air cannot to any appreciable extent be directed interiorly of the cans through their open ends. Furthermore, air cannot be directed essentially laterally toward the can to achieve good heat transfer since such movement would tend to flutter, and even dislodge the cans from respective pins. In any event, transfer of heat from the air to the can body is affected in an imperfect manner primarily along a can's outer surface.

An important disadvantage of this prior art system is that any stoppage of the chain-and-pin type of can-transfer system, usually because of a malfunction in the label-printing or coating apparatus, results in overheating of the cans which are stalled in the coat-curing oven. In a typical installation, a single stoppage involves the loss of at least a few dozen cans. Another disadvantage of the so-called "pin oven" is the length of the chain path due to limitations in the air-to-can heat transfer rate that can be achieved. When higher processing speeds are attempted, the length of the oven must be extended.

It has long been recognized that the "pin oven" achieves unsatisfactory use of the heat supplied to the oven and that there is a need for a coating-baking process that achieves higher rates of heat transfer to the workpieces. The pin-and-chain conveyor is obviously disadvantageous for baking inside coatings of cans because the pins must contact an interior surface, and also because heat transfer from exterior air to an interior coating involves the passage of heat through the can wall.

Current advances in the art of coating and baking finishes on cans indicate that it will soon be commercially feasible to coat cans both inside and outside and then pass the cans with the coatings in an initially wet condition through a suitable oven which can simultaneously harden the coatings at approximately equal rates without the coatings being in marring contact with any supporting means. Of immediate need is an oven which can efficiently heat and cure interior coatings without subjecting the outer surfaces of the cans to handling while the cans are in the oven. The term "cans" is used herein for brevity and for all types of containers adaptable to processing by apparatus disclosed herein.

Hence, objects of the invention are: to provide ovens for drying or curing coatings of containers, such as beverage cans, which achieve high heat transfer rates to the work and are thus economical in the consumption of fuel; to provide ovens of which the conveyors may be operated independently of container movements through other can-treating apparatus, such as labeling or coating machinery; to provide ovens which have the capability of efficiently curing interior coatings of cans, the exterior coating of the cans, and when coated both interiorly and exteriorly, curing both coatings simultaneously; provide coating-curing ovens which may be compactly arranged with short work paths while utilizing high temperatures, such as 800° F. or more, within an unusually uniformly heated oven atmosphere; and along with other objects, to provide ovens in which the heated gaseous medium may be directed from all directions at the exterior surfaces of the cans to achieve air impingement against lateral surfaces as well as end surfaces of the cans.

SUMMARY OF THE INVENTION

The invention resides in apparatus comprising an oven and a conveyor therethrough of which the basic accomplishment thereof is to simultaneously impinge strong currents of air or other gaseous medium on interior and exterior surfaces of cans, each having a closed end and an open end, advancing as a procession thereof through the oven to achieve more rapid and uniform heating of the can body and any initially wet or uncured coating material in situ on any surfaces of the cans. An essential feature of the invention is a structure provided for creating a difference in the pressure of air or other gas supplied to different portions of the open end of each can to induce air currents interiorly of the can. More specifically, the apparatus comprises a conveyor providing support for a procession of the cans as they pass through an elongate treatment region with the open ends of the cans engaged with the conveyor in an approximate plane forming one extremity of the region; an enclosure, normally a vacuum plenum, having an elongate intake port or slot-like inlet of substantially less width than the open ends of the containers. The intake port extends lengthwise along the middle of the can path and opens approximately along the plane for the passage of air or other gas centrally through the conveyor into the header along a central linear portion of the path substantially narrower than the open ends of the cans. The conveyor is divided into uniformly spaced portions which engage spaced rim portions of the containers defining their open ends and move concurrently along opposite sides of the intake port. The portions of the conveyor are also sufficiently narrow and spaced sufficiently closely to uncover portions of the open ends of the cans located outwardly from the intake port to define air inlet means along those outboard portions of the open ends of the cans for the passage of air into the open ends of the cans and then outwardly of the cans through the intake port. The apparatus further comprises air propelling or pumping means of any type for producing a lower air pressure inside the header than within the inlet means.

BRIEF DESCRIPTION OF THE DRAWING

FIG. 4 is a cross section in elevation of the apparatus of FIGS. 1 and 2 taken along line IV—IV of FIG. 2.

FIG. 5 is a fragmentary transverse cross section in elevation of one arrangement of apparatus for conveying cans through an oven while circulating air through the interior of the cans.

FIG. 6 is a fragmentary perspective view of support structure for cables used in conveying cans as shown in FIG. 5.

FIG. 7 is a fragmentary transverse cross section in elevation of plural path arrangement of apparatus for conveying cans through an oven while circulating air interiorly thereof.

FIG. 8. is a fragmentary transverse cross section in elevation of a modified arrangement employing the conveyor of FIG. 3 for transporting cans through an oven.

FIG. 9 is a fragmentary plan view illustrating conveyor portions in relation to a perforated supporting plate, such as used in the apparatus of FIG. 8.

FIG. 10 is a diagram of one arrangement of an air circuit, such as may be utilized in the apparatus of FIGS. 1, 2 and 4.

FIGS. 11 and 12 are diagrams of modified air circuits.

DESCRIPTION OF PREFERRED EMBODIMENTS

Figure 1:
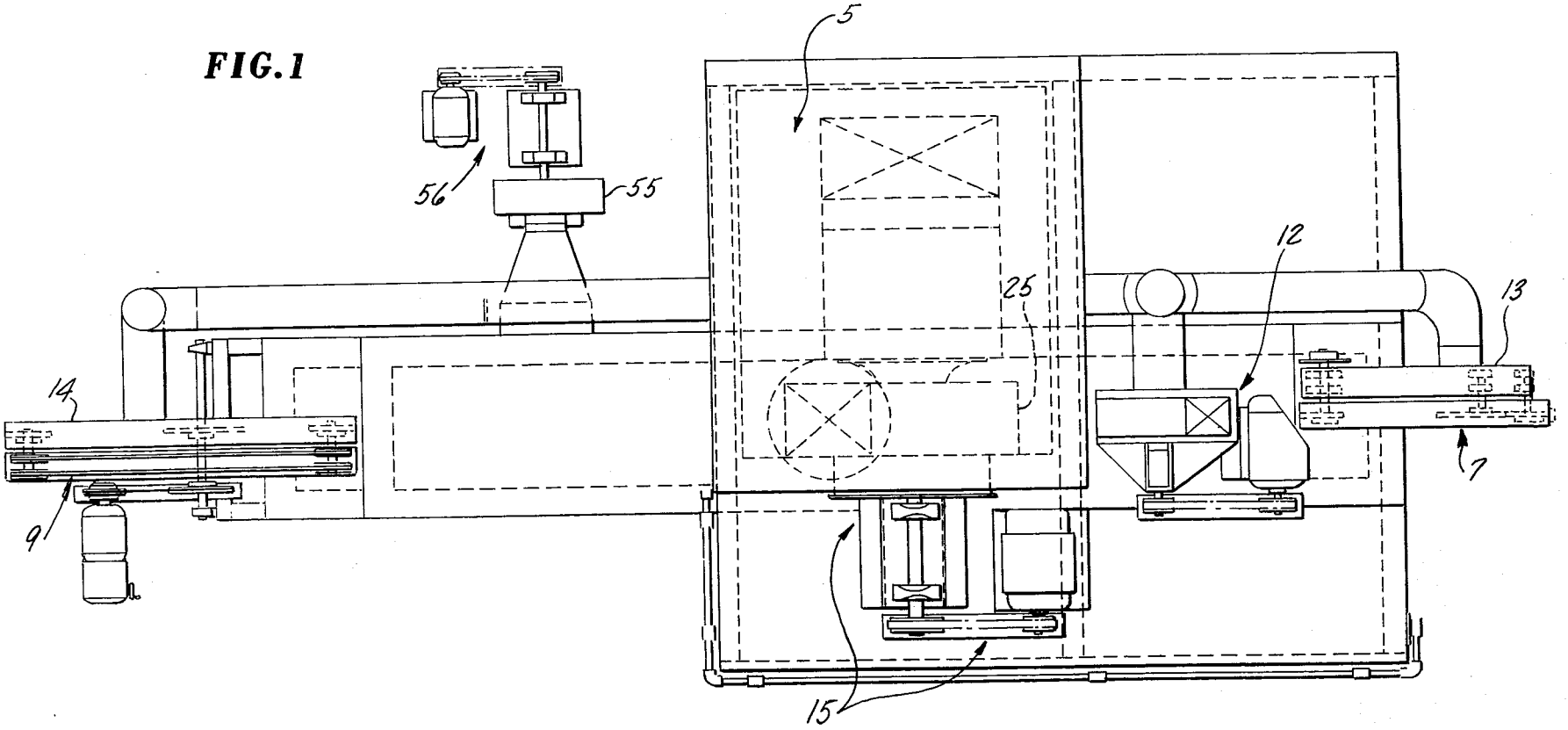
FIG. 1 is a plan view of an oven in accordance with the invention and various other auxiliary equipment for feeding cans into and taking them away from, the oven.
Figures 2, 3:
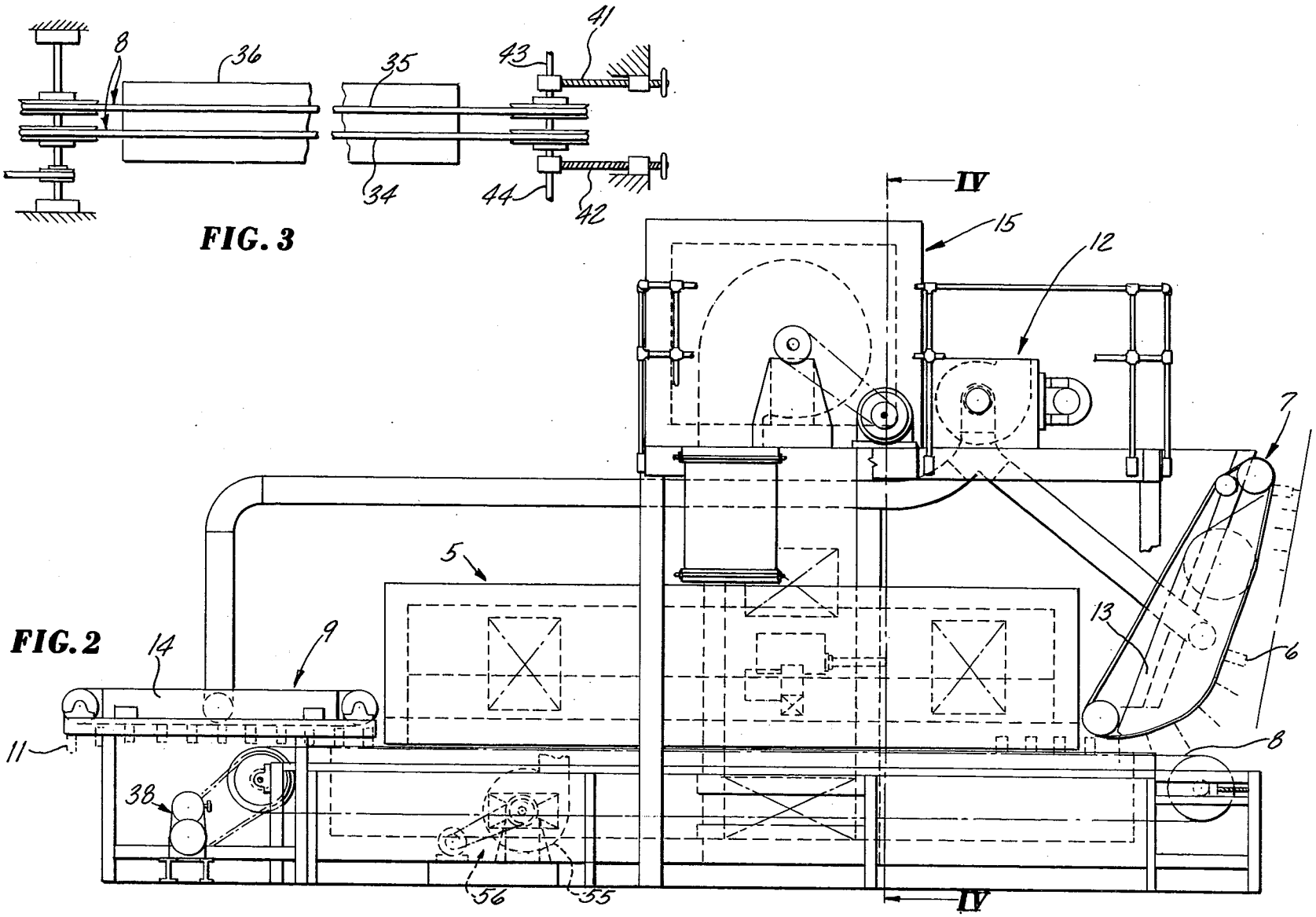
FIG. 2 is a side elevation of the equipment of FIG. 1.
FIG. 3 is a schematic plan view of a conveyor for advancing cans through the oven.

FIGS. 1 and 2 are plan and side elevation views, respectively, of an oven 5 for curing, hardening or drying coatings of a procession of cans 6 proceeding thereinto on being released by a feed conveyor 7 onto a conveyor 8 having its path through the oven 5. As the cans emerge from the oven 5 they pass under a longitudinally overlapping portion of a conveyor 9 which applies suction between spaced belts thereof to the closed ends of the cans and takes the cans to a location 11 wherein they are dropped for packaging or further processing. A motor and air pump unit 12 subjects the vacuum plenums 13 and 14 of conveyors 7 and 9, respectively, to negative air pressures.

Considering first the general features of the oven 5, air is circulated through the oven in a circuit illustrated by the arrows in FIGS. 4, 8, 10 and 11. As shown in FIG. 4, a motor-fan unit 15 with its intake 16 chamber 17 withdraws air from, and typically produces a partial vacuum, in the low-pressure part of the circuit consisting of a vacuum enclosure 21, a flue or duct 22 in which the air is subjected to heating by a heater 23, such as a gas flame burner, and the chamber 17. The higher-pressure portion of the circuit includes the outlet portion of the fan 24, a flue 25, and the elements of the oven connected therewith. The pressure is higher especially within the header 26 defining a plenum chamber 27. The lateral walls 28,29 of the header are bridged at their lower edge surfaces by a perforated longitudinally upwardly-arched diffuser plate. The arched portion of the diffuser plate at least partially laterally encloses the path of the cans 6 through their treatment region within the oven 5.

The header 26 along with the diffuser plate may be raised and lowered with respect to the flue 25 and the region traversed by the cans 6 while resting on a conveyor such as illustrated in FIGS. 5 or 8. The header preferably is vertically movable from its operating position as shown, since on occasion, the oven region traversed by the cans needs to be exposed for service and maintenance reasons.

As shown in FIGS. 4 and 8, the diffuser plate 31 has apertures 32 which will create a slight pressure drop between the outside of the diffuser plate and its interior region through which the cans 6 pass. Such pressure difference causes air to form into jets of sufficient velocity to impinge gently on the exterior surfaces of the cans. FIG. 8 also shows that the cans 6 rest on transversely separated endless parallel metal straps or tapes 34,35 which are portions of the conveyor 8 supported somewhat as shown in FIGS. 2 and 3. Within the oven 5, the straps 34,35 are supported on the top surface of a perforated flat plate 36 and pass frictionally thereover. The flexible straps 34,35 (conveyor 8) are driven in a leftward direction as viewed in FIG. 2 by a motor drive unit 38. Each strap of the conveyor is individually adjustable by mechanism, such as the screw devices 41,42 acting on separated drive shafts 43,44, respectively.

FIG. 9 shows that the belt straps 34,35 partially cover the plate 36, however, the apertured portions of the plate 36 outwardly from the middle of the plate beyond both straps constitute inlet means for air circulating immediately exteriorly of the cans 6 to enter into the cans. As FIGS. 8 and 9 further show, the plate 36 is perforated in the area thereof between the belt straps 34,35 but this portion of the plate 36 is contiguous only with an intake port 45 located between walls of solid sheet material comprising elements 47,48 on one side of the port and elements 51,52 on the other side of the port which extend lengthwise of the path of the conveyor 8 in uniformly transversely spaced relation forming a slot-like entrance to a region 53 formed by the enclosure 21 normally under vacuum.

Pressure drops occur at points described above where air enters the cans and again where air leaves the cans, i.e., between the interior of the can and the port 45. Obviously, then the pressure difference between the air at higher pressure in the region 27 than the lower pressure in the region 53 drives the air into the region enclosed by the diffuser plate 31, inwardly of the cans through the transversely outer portions of the plate 36 and through portions of the open ends of the cans transversely outwardly of the conveyor straps 34,35 and then outwardly of the cans through the intake port 45 of the region 53 normally at partial vacuum.

The air circuit diagram of FIG. 10 is typical of the aircirculation route effected in the equipment illustrated by FIGS. 1, 2 and 4. This system comprises an exhaust fan 55 and a drive unit 56 therefor situated with reference to the vacuum chamber 53 to exhaust air from the low pressure side of the circuit. As the portion of the circuit extending from plate 36 to the main recirculating fan 15 is normally under vacuum pressure, a damper 57 is situated in the circuit on the intake side of the fan 15 to admit air from the atmosphere to replenish the air withdrawn from the system through fan 55. The heater 23 located in the flue 22, heats the air passing to the intake of the fan 15 including replenishment air admitted through damper 57.

FIGS. 11 and 12 illustrate other circuits comprising different arrangements of circuit components for supplying heated air to the can ovens of this invention and producing a pressure difference on different end portions of the open ends of the cans as they traverse the oven. On all of the arrangements, the fan 15 and the plate 36 are at the essential points of pressure change, i.e., there is a pressure rise through the fan 15 and a pressure drop through the plate 36 surrounding assembly. Of note in FIG. 11 is replenishment air may be admitted to the system either along the vacuum portion by a hamper valve 61, or along the pressured portion by a fan for forcing air through the heater 23 to replenish the air and vapors withdrawn from the system by the exhaust fan 55. In FIG. 12, air is discharged from the pressured portion of the system at a hamper valve 65; replenishment air is admitted to the low pressure or vacuum portion of the system through a hamper valve 66. In all cases, the exhaust air from the system passes through the heater 23. FIGS. 10 and 11 follow the criterion of withdrawing the air from the low pressure portion of the system at which the polluting vapors are most concentrated.

FIG. 5 illustrates structure for supporting and advancing a procession of cans through a header and diffuser plate such as illustrated in FIG. 4. According to FIG. 5, cans in a single file procession are supported on a pair of cables 71,72 which are propelled over an endless belt supporting system in somewhat the same manner as straps 34,35 in FIG. 3. Because of the abrasive effect of the cables on plates such as plate 36, cables 71,72 are supported or cradled in fixed roller sprocket chains 73,74 as shown in more detail in FIG. 6. It is found that the typically hard steel rotatable rollers 75 provide an antifriction abrasion-resistant medium assuring long service life. Each cable and its respective supporting chain is supported in a recess 77 or 78 defined by appropriate shaping of the adjacent sheet metal structure. The recesses are of such depth as to locate a plane 79 passing across the upper surfaces of the cables slightly above the upper surface of a perforated intake port plate 81 and attached Z-plates 82,83. Region 85 is the intake port for a vacuum chamber such as that enclosed by enclosure 21. side links 76, of the chain extend upwardly along the sides of the cable and effectively channel the cables over the rollers 75.

FIG. 7 illustrates that an oven may comprise a plurality of paths typified by FIG. 8 extending in spaced parallel relation through a single oven. In FIG. 7, an oven 90 provides a double-arched diffuser plate 91 with arched portions 92,93 in superimposed relation with two can paths and respective intake ports 94,95 for a single vacuum chamber 96. The means for conveying the cans may take any suitable form such as the two types of apparatus illustrated in FIGS. 5 or 8. The can conveyors may be employed to move cans in the same direction through the oven or in opposite directions since in one case, the can paths may be employed to administer identical or similar treatments to cans or, in another case, employed to cure exterior coatings on the cans while proceeding in one direction, emerging from the oven and receiving an interior coating, and then being placed in the oppositely directed can path to proceed again through the oven in the reverse direction to cure the inside coating.

What is claimed is:

1. Apparatus for treating a procession of similar containers each of which has an open end and a closed end comprising:

a conveyor providing support along a path for a procession of the containers while traversing an elongate treatment region with the open ends thereof engaged with the conveyor in an approximate plane forming one extremity of said region;

enclosure means having an elongate intake port means of substantially less width than said open ends, said port means opening along, and extending centrally along, said path for the passage of air or other gas centrally through the conveyor into the enclosure means along a central linear portion of said path substantially narrower than said open ends;

said conveyor comprising uniformly spaced support means for the containers moving concurrently along opposite sides of said intake port means;

inlet means located transversely outwardly of said inlet port means providing space for passage of air into portions of the open ends of said containers extending transversely beyond said intake port means; and air pumping means for producing a drop in air pressure at said intake port means such that the pressure is lower inside said enclosure means than at said inlet means.

2. The apparatus of claim 1 wherein:

said air pumping means is connected with said enclosure means to withdraw air therefrom and reduce the pressure therein below that at said inlet means.

3. The apparatus of claim 1 wherein:

said air pumping means is connected with said inlet means to increase the air pressure therein to a higher level than in said enclosure means.

4. The apparatus of claim 1 comprising:

conduit means connecting said enclosure means with said inlet means;

said air pumping means being included in said conduit means to extract air from said enclosure means and to forward air to and through said air inlet means.

5. The apparatus of claim 1 comprising:

wall means in parallel proximity with said plane providing an elongate opening as said intake port means;

said conveyor comprising, as said spaced support means, a pair of tapes at opposite sides of said opening and means for longitudinally advancing the tapes lengthwise of said path;

said tapes being spaced apart and sufficiently narrow to cause desired portions of the open ends of the cans to be located transversely outwardly beyond the tapes in directions away from said port means.

6. The apparatus of claim 5 wherein:

said wall means extends outwardly from said tape means and is perforated to facilitate the entry of air into said containers and into said intake port means.

7. The apparatus of claim 5 wherein said tapes are endless and each is supported on a separate group of pulleys, the apparatus comprising:

separate means for individually tensioning said tapes; and means for transversely adjusting the respective pulleys of said tapes to achieve different spacings of the tapes.

8. The apparatus of claim 1 comprising:

a header means surrounding said region and the portion of said conveyor coextending with said enclosure means;

conduit means connecting said enclosure means with said header means;

said air pumping means being included in said conduit means to extract air from said enclosure means and to forward the air to said header means, said header means being in fluid communication with the entire length of said inlet means;

said header means having opposite ends with apertures therein adjacent said conveyor for passage of containers into and out of said header means; and means for adjusting the air pressures at said inlet means and said intake port means to an air pressure difference preventing substantial discharge of air through said apertures.

9. The apparatus of claim 8 comprising:

heating means for air included in an assembly comprising said duct means and said header means, said assembly being arranged to advance air discharged from said enclosure means through said heating means.

10. The apparatus of claim 9 comprising:

extracting means mounted in fluid relation with an assembly comprising said conduit and said header means for withdrawing gases from the assembly;

air injection means for admitting air into said assembly;

said extracting means and air injection means being adjustable to maintain a desired dilution of the atmosphere circulated through said assembly.

11. The apparatus of claim 10 wherein:

said extracting means is downstream from said enclosure means and said air injection means is downstream from said extracting means.

12. The apparatus of claim 11 wherein:

said air injection means is upstream of said air pump means and said heating means.

13. The apparatus of claim 1 wherein:

the spaced support means for the containers comprises a pair of synchronously movable cables and a pair of lengths of roller chains extending coextensively with at least the length of said region, each cable being cradled by one of said lengths with the cable resting on the rollers thereof; and under support means for each length of chain for supporting said chains in such uniformly parallel relation with said plane as to maintain continuous upper most surface portions of both cables in generally tangent relation with said plane.

* * * * *